United States Patent [19]

Hornsby, Jr.

[11] 3,936,050

[45] Feb. 3, 1976

[54] TETHER BALL APPARATUS WITH ATTACHED STRIKING MEMBERS

[76] Inventor: James R. Hornsby, Jr., 6239 Edgewater Drive, Orlando, Fla. 32810

[22] Filed: Aug. 21, 1974

[21] Appl. No.: 499,280

[52] U.S. Cl. ..... 273/95 A; 273/85 D

[51] Int. Cl.[2] ..... A63B 71/02

[58] Field of Search..... 273/95 A, 97, 98 R, 101, 273/85 C, 85 D, 94 C, 94 D

[56] References Cited

UNITED STATES PATENTS

| | | | |
|---|---|---|---|
| 2,239,014 | 4/1941 | Peterson | 273/95 A |
| 3,724,851 | 4/1973 | Cecchetti | 273/85 D |
| 3,799,545 | 3/1974 | Petrusek | 273/97 R |

*Primary Examiner*—Anton O. Oechsle
*Assistant Examiner*—Marvin Siskind
*Attorney, Agent, or Firm*—Roylance, Abrams, Berdo & Kaul

[57] ABSTRACT

A tether ball game includes an upstanding pole having a ball connected thereto by a string. At least two movable contact members can be manually operated to hit the ball and to cause the ball and the string to wrap around the pole. The contact members are carried by mounting means which are horizontally movable toward and away from the pole and which are rotatable to hit the ball and propel the same in the desired direction.

7 Claims, 4 Drawing Figures

TETHER BALL APPARATUS WITH ATTACHED STRIKING MEMBERS

This invention relates to games or amusement devices and more particularly it relates to a game of the type where a ball is tethered to an upstanding pole and where two players or more try to hit the ball in opposite directions to cause the ball and its tethering string to wrap about the pole.

The ordinary tether ball game is played outdoors using a large pole with a full size ball tethered thereto. The players then use either rackets or their hands to hit the ball and to cause the same to wrap around a pole. The present invention is directed to an indoor type of tether ball game, using the same principles as the outdoor game, but capable of being played in a small area and by small children. The game of the present invention can be easily played by small children who would otherwise have difficulty in playing a full size tether ball game, and additionally, such small children will acquire the benefits of skill and coordination while at the same time engaging in an enjoyable contest.

It is accordingly, an object of the present invention to provide a new and improved form of game, in the nature of a tether ball game, which can be played by children or adults and which will provide enjoyment while improving coordinated skills.

Another object of the present invention is to provide a game which is simple in construction and operation, can be produced in a relatively inexpensive manner, yet which is capable of being played for extended periods of time without failure or breakage.

Other objects, advantages and salient features of the present invention will become apparent from the following detailed description, which, taken in conjunction with the annexed drawings, discloses two preferred embodiments.

The foregoing objects are attained generally by providing a central upstanding vertical pole having a ball tethered thereto by a string. A pair of horizontally extending opposed rods extend outwardly from the central pole. In the first embodiment of the invention, the horizontally extending rods carry a hollow tube which is slidably mountable on the rods. The tube itself carries both a handle and a contact member which is adapted to contact against and hence propel the tethered ball. The operator manually grasps the handle and slides the tube axially along the rod until the contact member is at the correct position to meet the swinging ball. Then, just as the ball is about to come into engagement with the contact member, the handle is rotated to cause the contact member to hit the ball and propel the same in either a clockwise or counterclockwise direction, with the objective being to wrap the ball and string about the pole. The opposing player, of course, tries to hit the ball in the opposite rotational direction. In the second embodiment of the invention, the contact member is carried by the rod itself. The rod is projected through transverse cross bar members at the outer end of the game and the projecting end of the rod is bent to form a handle which can be manually grasped for the axially slidable movement and the rotational movement. In this second embodiment, a game board with a groove therein extends under the rods and a guide member at the inner end of the rod slides in the groove to hence guide the movement of the rod.

Referring now to the drawings wherein the invention is shown in further detail, which drawings form a part of this original disclosure:

Figure 1:
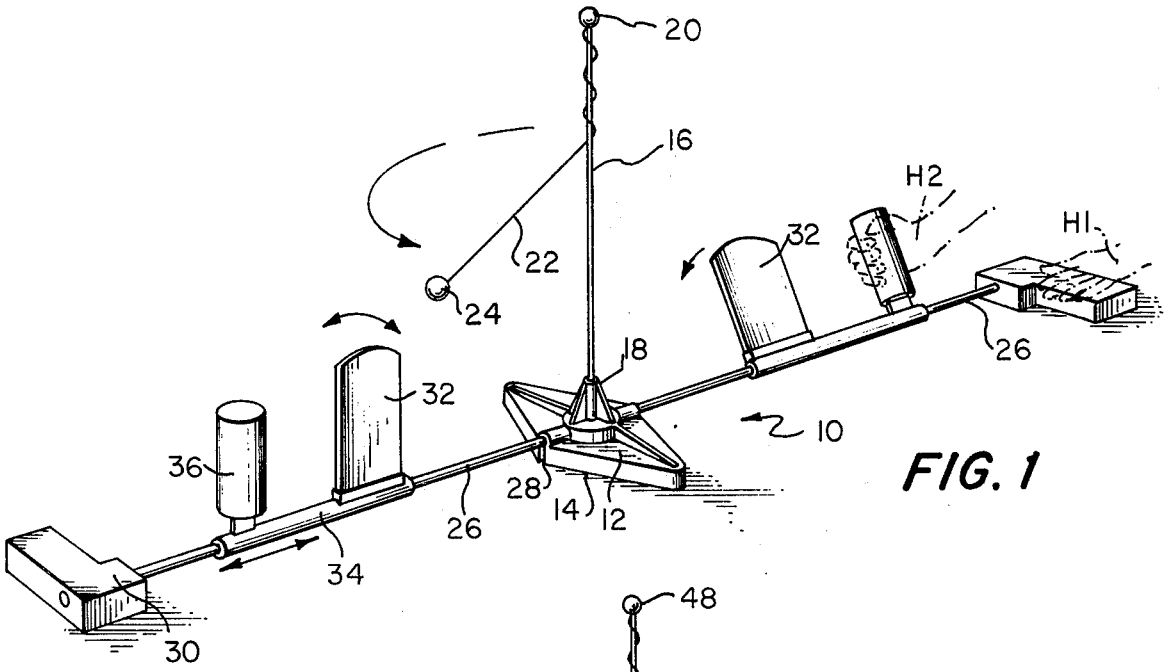
FIG. 1 is a perspective view of a first embodiment of the present invention.

Referring now to the drawings, the apparatus illustrated in FIG. 1 comprises a tether ball game generally designated 10. It includes a central stand means 12 having a flat bottom surface 14 adapted to rest upon a horizontal supporting surface. The central stand means carries an upstanding pole 16 the lower end of which is mounted in an upstanding sleeve 18 on the central stand and the upper end of which carries a small ball 20. A string 22 is carried by the ball 20 at the upper end of the vertical pole 16 and at the opposite or outer end of the string 22 there is provided the ball 24 which forms the tether ball. The string or cable 22 serves to tether the ball 24 to the upper end of the pole 16.

A pair of horizontally extending rods 26 project from opposite sides of the central stand 12 and extend horizontally outwardly therefrom. The inner end of each rod 26 is inserted frictionally into a receiving groove or channel 28 on the central stand. At the outer end of each rod 26, a pressure plate 30 is provided. This pressure plate 30 is adapted to be pressed manually against the supporting surface by one of the operator's hand, as designed Hl in FIG. 1. The thickness of each pressure plate 30 is such that the rod 26 is spaced slightly above the horizontal supporting surface upon which the game 10 rests.

In order to contact and hit the tethered ball 24, a pair of contact members 32 are provided with each member having at least one flat side surface and preferably a pair of opposed flat side surfaces. The members 32 are carried by mounting means which are horizontally axially slidable toward and away from the pole 16 and which are also rotatable to accomplish a swinging motion of the contact members. In the embodiment of FIG. 1, the mounting means comprises a hollow tube 34 slidably mounted upon the horizontally extending rod 26. The outer diameter of each hollow tube 34 is such that it will still be spaced slightly away from the supporting surface upon which the game rests so that the tube 34 and the contact member 32 is attached thereto can be slidably moved along the rod 26 without frictional engagement against the supporting surface. The contact member 32 can be integrally formed with the tube 34 or can be removably attached thereto. In any event, as shown in FIG. 1, it is mounted near the inner end of the tube 34. Adjacent the outer end of the tube 34 there is provided an upstanding handle 36 which is capable of being grasped by the other of the operator's hands, designated H2 in FIG. 1. It will be noted that the contact member 32 and the handle 36 are substantially coplanar along the tube 34, and while this is not absolutely required, it does simplify operation of the device and playing of the game.

The various arrows shown in FIG. 1 designate the direction of movement of the various parts. Once the operator grasps the handle 36, he or she can move the same in a horizontal direction, axially of the rod 26, thereby moving the contact member 32 carried by the tube 34 toward or away from the upstanding vertical pole 16. The objective, of course, is to move the contact member to a position where the tethered ball 24, which is swinging rotationally about the pole 16 as a result of being hit by the opposing player, will come into contact with the contact member 32. Just as this contact between the member 32 and the ball 24 occurs, the operator rotates the handle 36, thereby rotating both the tube 34 and the contact member 32 about the rod 26. This rotational movement will hit the ball 24 and will drive the same in an opposite rotational direction. The objective of the game, of course, is to see which of the players can first cause the ball and string to wrap completely about the pole 16. If desired, in the embodiment of FIG. 1, additional grooves 28 can be formed in the central stand and additional horizontal rods can be provided, extending approximately at right angles to the rods now illustrated. This would enable the game to be played by four players rather than two, but it has been found that two players provide an optimum number for playing tether ball.

Figure 2:
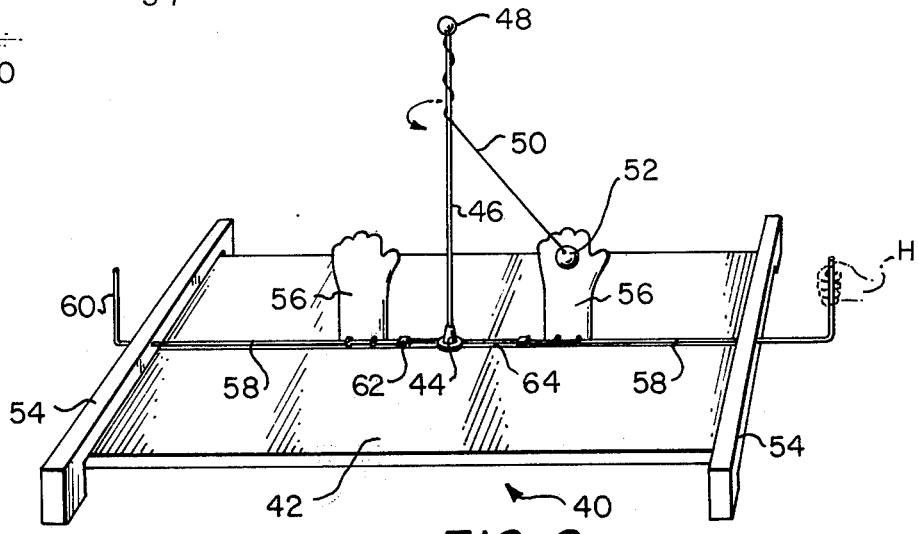
FIG. 2 is a perspective view of a second embodiment of the present invention.

Referring now to FIG. 2, there is illustrated therein a further embodiment of the present invention, this second embodiment being generally designated 40. In the second embodiment, a horizontal game board 42 is provided. A small central stand 44 is attached at the center of the board 42 and it serves to mount an upstanding vertical pole 46 having a small ball 48 at the top thereof. A string 50 tethered to the upper end of the vertical pole 46 carries at the other end thereof a ball 52 which forms the tether ball of the second embodiment. A pair of cross bars 54 are provided at opposite ends of the board 42 to serve as part of the mounting means for the contact members 56. In this embodiment, the contact members are formed as simulations of a hand but they still have a flat surface on at least one side, and preferably both sides, thereof.

Figure 3:
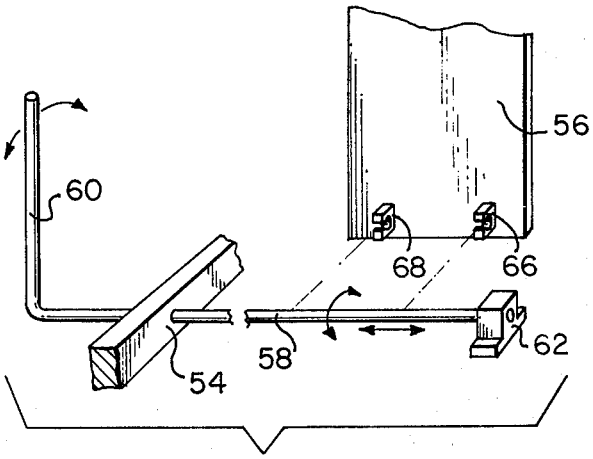
FIG. 3 is a fragmentary perspective view showing a portion of the second embodiment.

A pair of horizontally extending rods 58 are provided, with each rod projecting through the cross bar 54 and having formed at the end thereof, a right angle portion 60 which serves as the handle means. At the opposite end of the rod 58, there is mounted a guide member 62, which is shown in further detail in FIG. 3. The guide member 62 is adapted to slide in a horizontally extending groove 64 which extends along the board 42 from the cross bar to the center stand or support 44. It can thus be seen that the rod member 58 is supported at one end by the guide member 62 and is supported inwardly of its handle end by means of the cross bar 54. The contact member 56 can be attached to the horizontally extending rod 58 in any suitable manner, as for example, by providing small detents 66 as illustrated in FIG. 3. Each of these detents has a grove 68 formed therein into which the rod 58 can be frictionally engaged. In the embodiment of FIG. 2, only a single hand need be used to operate the device, such hand being designated H. The hand grasps the handle 60 and by pushing or pulling thereon, the operator axially and horizontally moves the contact member 56 toward or away from the pole 46. When the contact member reaches the correct position and when the ball 52 is about to come into engagement therewith, the operator simply rotates the handle 60, thus causing the contact member to strike against the ball 52 and wrap the same about the pole. The rod 58 is spaced a sufficient distance above the surface of the game board 42 to permit a significant amount of rotation of the contact member. Likewise, while the rod is engaged in the bearing member or guide member 62, such engagement is of the type which permits the rod to freely rotate therein. The guide member 62 merely serves to slide within the groove or slot 64 to assure that the rod 58 will stay in proper alignment.

Figure 4:
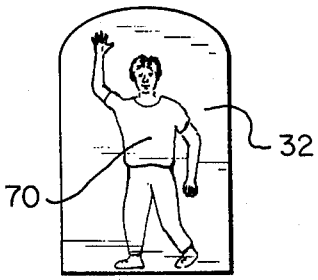
FIG. 4 is a side elevational view of a modified form of contact member.

Referring to FIG. 4, there is illustrated therein a contact member having imprinted thereon or otherwise applied thereto, decorative indicia in the form of a FIG. 70. It is contemplated that the contact members of the present invention can be in the form of a hand 56, plain or unadorned, decorated with indicia, or in the form of any other type of figure which might be visually attractive and interesting. The only real requirement is that at least one surface thereof be flat for engagement against and contact with the tethered ball.

After reading the foregoing detailed description, it should be apparent that the objects set forth at the outset thereof have been successfully achieved by the present invention. However, various changes apparent to those of ordinary skill in the art may be made without departing from the spirit and scope of the invention as defined in the appended claims.

What is claimed is:

1. A tether ball game comprising a vertically upstanding pole;

a ball;

a string connected between said ball and the upper end of said pole;

a plurality of contact members each having at least one flat side surface;

mounting means for said contact members, said mounting means being horizontally axially slidable toward and away from said pole to move said contact members to a position where the flat side surface thereof can contact against said ball, said mounting means also being rotatable about said horizontal axes to swing said contact members until the flat side surfaces thereon contact said ball and propel the same in a rotary motion about said pole to cause said string to wrap around said pole, said mounting means also being manually operable and includes a handle member which can be manually gripped to accomplish said axial sliding and said rotational movement about said horizontal axes, rod means extending horizontally outward from said pole, said rod means serving as the said mounting means for said contact members; and a planar board having cross bars at opposite ends thereof, said rod means projecting through apertures in said cross bars;

wherein that portion of said rod means projecting beyond said cross bars forms said handle member which can be manually gripped to accomplish said axial sliding and said rotational movement about said horizontal axes, and wherein said planar board has groove means formed therein beneath said rod means and the inner end of each of said rod means carries a depending guide member slidable within said groove means.

2. A tether ball game as defined in claim 1 wherein said contact members have detents thereon frictionally engageable with said rod means to mount said contact members on said rod means.

3. A tether ball game as defined in claim 1 wherein each of said contact members simulates a hand.

4. A tether ball game as defined in claim 1 wherein each of said contact members simulates a figure.

5. A tether ball game comprising:

a vertically upstanding pole;

a ball;

a string connected between said ball and the upper end of said pole;

a plurality of contact members each having at least one flat side surface;

mounting means for said contact members, said mounting means being horizontally axially slidable toward and away from said pole to move said contact members to a position where the flat side surfaces thereof can contact against said ball, said mounting means also being rotatable about said horizontal axes to swing said contact members until the flat side surfaces thereon contact said ball and propel the same in a rotary motion about said pole to cause said string to wrap around said pole, said mounting means also being manually operable and including a handle member which can be manually gripped to accomplish said axial sliding and said rotational movement about said horizontal axes;

rod means extending horizontally outward from said pole, said mounting means comprising hollow tube means slidably mounted upon said rod means, each of said hollow tube means being axially elongated and carring said contact member at one end thereof and said handle member at the other end thereof;

a pressure member mounted at the outer end of each of said horizontally extending rod means, with the pressure member being manually pressed against a supporting surface by one of the operator's hands while the other of the operator's hands controls movement of said mounting means; and a central stand means adapted to rest on a flat supporting surface, said pole member having its lower end mounted in said central stand means and said horizontally extending rod means having their inner ends mounted in said central stand means.

6. A tether ball game as defined in claim 5 wherein the distance between said rod means and said supporting surface is greater than the wall thickness of said hollow tube means whereby said hollow tube means is freely slidable on said rod means without frictional engagement against the supporting surface.

7. A tether ball game as defined in claim 5 wherein each of said contact members includes an upstanding planar surface having a simulation of a figure thereon.

* * * * *